United States Patent [19]

Durand et al.

[11] 4,397,514

[45] Aug. 9, 1983

[54] SELF-CLAMPING ELECTRICAL CONNECTORS AND TERMINAL BLOCKS

[75] Inventors: Guy Durand, Montville; Daniel Paulin, Bosc le Hard, both of France

[73] Assignee: Legrand, Limoges, France

[21] Appl. No.: 250,158

[22] Filed: Apr. 2, 1981

[30] Foreign Application Priority Data

Apr. 4, 1980 [FR] France ..... 80 07675

[51] Int. Cl.[3] ..... H01R 4/48

[52] U.S. Cl. ..... 339/95 D; 339/262 R

[58] Field of Search ..... 339/95 R, 95 D, 258 R, 339/258 C, 258 P, 262 R

[56] References Cited

U.S. PATENT DOCUMENTS

| | | | |
|---|---|---|---|
| 2,591,009 | 4/1952 | Riche | 339/256 SP |
| 2,946,036 | 7/1960 | Bettencourt | 339/95 D |
| 3,315,052 | 4/1967 | Mo Goto | 200/67 |
| 4,038,573 | 7/1977 | Hillyer et al. | 339/95 D |

FOREIGN PATENT DOCUMENTS

| | | | |
|---|---|---|---|
| 2432084 | 1/1976 | Fed. Rep. of Germany . | |
| 2136550 | 12/1972 | France . | |
| 2208210 | 6/1974 | France . | |
| 2224890 | 10/1974 | France . | |
| 2307382 | 11/1976 | France . | |
| 2351516 | 12/1977 | France | 339/95 D |
| 684295 | 3/1965 | Italy | 339/258 |
| 466821 | 6/1937 | United Kingdom . | |
| 751675 | 7/1956 | United Kingdom . | |
| 1272784 | 5/1972 | United Kingdom . | |
| 1447935 | 9/1976 | United Kingdom . | |
| 2049307 | 12/1980 | United Kingdom | 339/95 D |

*Primary Examiner*—John McQuade
*Assistant Examiner*—Gary F. Paumen
*Attorney, Agent, or Firm*—Charles E. Brown

[57] ABSTRACT

A self-clamping electrical connector or terminal block is disclosed having one or more entrance passages for inserting a corresponding number of conductive cores of leads. A U-shaped metal guide member is mounted in the housing and a leaf spring part with a corresponding number of leaf springs each having an angled portion extending between the legs of the guide member. The angled portion is adapted to clamp the conductive core against one of the legs upon insertion of the lead. Each leaf spring comprises clipping means including a bowed portion connected to the angled portion and a flat portion. The bowed portion bears on the inner surface of the other leg of the guide member and the flat portion bears against the outer surface of said other leg. A lug may be provided on the leg to prevent the leaf spring part from slipping off the guide member.

15 Claims, 9 Drawing Figures

SELF-CLAMPING ELECTRICAL CONNECTORS AND TERMINAL BLOCKS

The present invention relates generally to self-clamping electrical connectors and terminal blocks, i.e., such connectors and terminal blocks whose terminals do not employ any screws for clamping an electrical conductor and in which the stripped end of the electrical conductor is simply inserted into the connector. The present invention thus relates to both such electrical connectors for inter-connecting two or more electrical conductors and simple terminal blocks for one or more leads which are electrically isolated from any other electrical conductors.

Such self-clamping electrical connectors and terminal blocs have long been known, going back to British Pat. No. 466,821 for example.

Generally speaking, such self-clamping electrical connectors or terminal blocks comprise an insulating housing having at least one entrance passage for insertion of the conductive core of an electrical conductor, a metal part which will be referred to as the guide member, and a leaf spring which is angled with respect to the entrance passage so that when the conductive core of the electrical conductor or lead is inserted into the entrance passage the leaf spring automatically clamps the same against the guide member. In practice when the electrical connecting device constitutes an electrical connector there are obviously two or more entrance passages.

In the aforesaid British patent the entrance passages are disposed on opposed sides of the housing. But it is also known to provide such entrance passages on the same side of the housing as dislcosed, for example, in French printed patent application No. 2,224,890 and British Pat. No. 1,272,784.

To protect the insulating housing from the forces developed by the leaf spring when clamping the conductive core, it has been proposed to form the leaf spring and guide member as a self-supporting assembly so that the guide member alone has to withstand the reaction forces of the leaf spring and not the insulating housing. Such an arrangement is disclosed in the British patent mentioned above, wherein some of the embodiments comprise a framelike guide member for lodging the associated leaf spring. It has also been proposed to provide an open U-shaped guide member or form it from angle members.

This gives rise to the problem of insuring the connection of the guide member with the leaf spring for forming the self-supporting assembly. Most often, as is the case in French printed patent application No. 2,224,890 referred to above, the leaf spring is riveted to the guide member. The rivet is either a separate part or is integrally formed lug on the guide member by suitable cutting out and bending, like a staple. In either case such a rivet necessarily protrudes substantially outwardly from the guide member and therefore substantially increases, at least locally, the size of the device perpendicular to the direction of lead insertion. Furthermore, when the rivet is formed by an integrally formed lug its mechanical strength over a period of time and therefore the resilient clamping capacity of its leaf spring which it secures are thus dependent upon the material of which the guide member is made, and more particularly the creep strength of the guide member material. But since such a guide member has, as its principal function, to provide good electrical connection it is usually made of copper or tin-plated copper which materials are known to creep after a period of time. Under these circumstances it is not rare for play to develop in the mechanical connection between the guide member and the leaf spring which is detrimental to clamping capacity of the leaf spring and therefore detrimental to the electrical connecting characteristics of the ultimate electrical connection.

An object of the invention is the provision of a self-clamping electrical connector or terminal block free from the foregoing drawbacks, and having additional advantages.

According to the invention there is provide a self-clamping electrical connector or terminal block comprising an insulating housing, at least one entrance passage for inserting a conductive core of a lead, a U-shaped guide member, and a leaf spring having a portion angled with respect to the axis of the entrance passage and extending between legs of the U-shaped guide member, the angled portion of the leaf spring member being adapted to clamp, upon insertion, the conductive core of the lead against one of the legs of the guide member, the leaf spring member comprising means including a bent-over portion for clipping the leaf spring on the other of the legs of the guide member.

Thus the mechanical securement of the leaf spring on the guide member to define the self-supporting assembly does not depend on the inherent properties of the material constituting the guide member thereby advantageously insuring permanent electrical connecting characteristics over a period of time.

Preferably, the clipping means comprises resilient clipping means comprising a bowed resilient portion of the leaf spring.

Preferably, a fulcrum zone is formed between the bowed resilient portion and the angled portion against the inner surface of the other leg of the guide member whereas a flat or planar part of the bent-over portion of the leaf spring bears against the outer surface of the said other leg of the guide member.

The bowed spring construction of the leaf spring member has a dual advantage. First of all, when the conductive core of the electrical conductor is inserted between the leaf spring and the guide member, a force exerted to pull the electrical conductor out of the electrical connector or terminal block flexes or arches the angled portion of the leaf spring and increases the radial component exerted against the conductive core thereby effectively and forcefully preventing the conductor being pulled out of the electrical connector or terminal block.

Further, the inherent resilience of the bowed spring portion permits the electrical connector to automatically compensate for different diameter conductive cores, the torsional resilience of the bowed resilient portion advantageously combining with the bending resilience of the leaf spring.

Furthermore, owing to the clipping means comprising a bent-over portion of the leaf spring the resulting mechanical securement of the leaf spring on the guide member causes only a minimum projection beyond the guide member so that the dimension of the leaf spring-guide member assembly is advantageously reduced perpendicular to the conductor insertion direction. The projection is in practice reduced to the thickness of the leaf spring even when a retaining lug is provided in association with an aperture in the bent-over portion of the leaf spring to prevent the leaf spring from gradually slipping off the guide member.

Finally, the clipping means on the leaf spring for securement on the guide member admits of a relatively simple and economical assembly operation, notably in contrast to the usual riveting employed up to the present day for securement of the leaf spring.

Further, a strike or tongue preferably at the free end of the angled portion of the leaf spring is provided for cooperation with the conductive core of the wire, the strike or tongue being bent toward the said one leg of the guide member against which the conductive core is clamped.

This produces a dual advantage. To begin with, the strike or tongue which constitutes the active part of the leaf spring, i.e., the part of the leaf spring which actually retains the conductive core of the associated wire against the said one leg of the guide member defines a greater angle than that defined by the rest of the angled portion of the leaf spring and thereby is better adapted to anchor the conductive core of the wire. Further, the active or biting edge of the strike is thus protected from any contact with the guide member, since it is set back with respect to the angled portion of the leaf spring so that the angled portion edge alone bears against the guide member in the rest position. The active edge of the strike from the leaf spring is thus spared any peening, which is thus beneficial to its clamping function, and it retains its physical configuration and its sharp edge.

There is also a longitudinal offset between the active or biting edge of the leaf spring and the rest of the angled portion of the leaf spring so that when the conductor is not received therein the free edge of the angled portion bears against the said one leg and bites into the same, this is not deleterious to the ultimate electrical contact between the conductive core and the guide member since the contact pressure between the conductive core and the guide member is effected by the spring load of the strike at a location spaced from where the angled portion of the leaf spring may have bitten into the said one leg.

In practice, when the device is used as an electrical connector connecting two or more electrical conductors, a plurality of leaf springs are provided side by side, the leaf springs being part of the same part, slots separating the plurality of leaf springs from one another. Preferably, the slots separating the leaf springs have spaced apart edges. In other words, the slots are not obtained merely by shearing the leaf spring part but rather are blanked out on a press.

This arrangement provides a real degree of freedom of movement of the leaf springs relative to one another in both directions, which is not the case when the slots separating the leaf springs are merely sheared between one another since the resulting edges would necessarily be irregular thereby permitting freedom of movement of the leaf springs relative to one another in only one direction. Owing to the spaced apart edges of the slots the leaf springs are totally independent of one another whereby the pressure developed by any one of the leaf springs against its associated conductive core is not affected by the degree of clamping of the others.

In practice since, as is known per se, the housing has at least two entrance passages for insertion of the conductive cores of wires on the same side, the bight portion of the guide member has apertures in alignment with the respective entrance passages to accommodate the free ends of the associated conductive cores.

Preferably, the U-shaped guide member is oriented to open facing the entrance passage aligned therewith. Accordingly each wire, and therefore its conductive core, is advantageously guided to either side of the zone of electrical contact defined by the corresponding leaf spring by the entrance passage in the housing on one side of the contact zone and by the aperture in the bight portion of the guide member on the other side of the contact zone.

Optimum stability of the electrical contact zone thus results and since the contact zone carries relatively low voltage this contributes to a good electrical connection, any possible displacement of the contact zone thus being advantageously avoided.

Since, in a preferred embodiment of the electrical connector two or more conductor cores are connected as is known per se, the housing is preferably of hollow configuration having an open end closed off by an insert or plug. Preferably, the entrance passages are formed in the insert or plug closing off the open end of the hollow housing. The resulting housing is therefore relatively simple to mold since it requires no slides.

These and other features and advantages of the invention will be brought out in the description which follows given by way of example with reference to the accompanying schematic drawings, in which.

Figure 1:
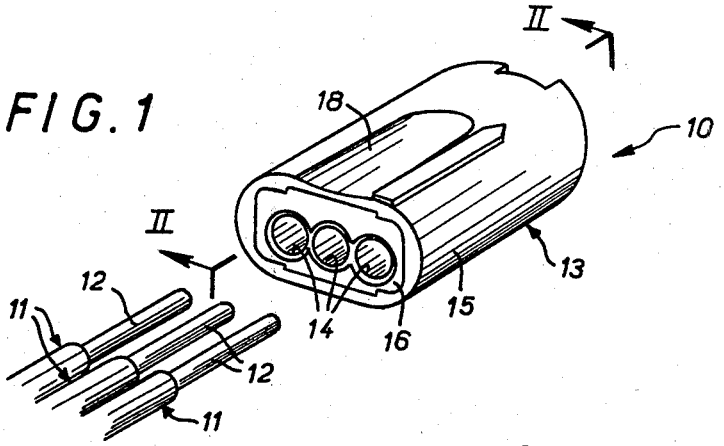
FIG. 1 shows a perspective view of a self-clamping electrical connector embodying the invention.

The drawings illustrate the application of the invention to the construction of a self-clamping electrical connector 10 for electrically connecting two or more electrical conductors or leads 11 after stripping the insulation from the end of the conductive core 12.

Such an electrical connector 10 generally comprises an insulating housing 13 having at least two entrance passages 14 arranged adjacent one another on one side of the housing, in which the conductive cores 12 of electrical conductors 11 are adapted to be inserted. In the illustrated embodiment there are three such entrance passages, but obviously their number is in no way limitative of the present invention.

In a practical embodiment the housing 13 comprises a hollow body 15 shaped like a flattened glove finger and an insert or plug 16 adapted to be received in the open end of the hollow body 15. Depressions 18 are disposed along the opposed main sides of the housing 15 to facilitate gripping in the user's hands (see FIGS. 1 and 2). At the other end of the housing 13 remote from the insert 16 is a recess for conventional voltage control means.

In the illustrated embodiment the insert or plug 16 comprises a shoulder 20 which is adapted to bear against a complementary shoulder 21 in the housing. The insert or plug 16 may be secured to the housing by bonding, e.g., heat-sealing or glueing, or detents, or the like. When bonding is employed, it is applied in the plane of the shoulders 20, 21 or perpendicular thereto.

Each entrance passage 14 is formed of two consecutive sections, namely, a first, larger diameter section 22 adapted to receive the unstripped end of the electrical conductor 11 and a second, smaller diameter section 23 adapted to receive only the conductive core 12 of such a lead or conductor 11.

In the housing 13 is provided at least one U-shaped metal part referred to as a guide member 25. The guide member may be made of tin-plated copper. It comprises two legs 26, 27 extending parallel to the main sides of the hollow body 15 between the two inner shoulders 28, 29, and a bight portion 30 extending transversely, in contact with the end wall 31 of the hollow body 15 remote from the insert or plug 16. The U-shaped configuration of the guide member 25 opens outwardly into the entrance passage 14.

In the guide member bight portion 30 is provided an aperture 33 in alignment with the associated entrance passage 14. There are thus three apertures 33 in the bight portion 30 of the illustrated embodiment. A cavity 34 is provided in the end wall 31 in the hollow body 15 in alignment with these three apertures 33.

Figure 6:
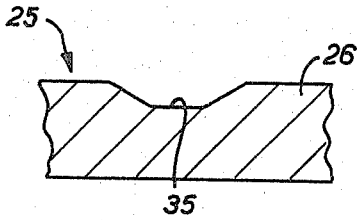
FIG. 6 shows, on a larger scale, a fragmentary cross-sectional view taken on line VI—VI in FIG. 4.
Figure 7:
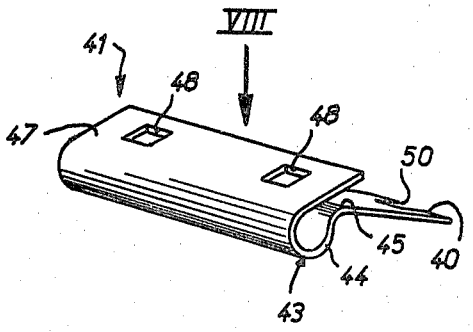
FIG. 7 shows a perspective view of part comprising the plurality of leaf springs, taken on its own.

A groove 35 is provided along the inner surface of one of the legs 26 of the guide member 25 along the axis of the entrance passage 14. As shown in the illustrated embodiment in FIG. 6 such a groove 35 may preferably have a trapezoidal cross-section.

On the outer surface of the other leg 27 of the guide member 25 protruding along each of the longitudinal sides of the leg and adjacent the lateral edge is a lug 37. In the illustrated embodiment the lug 37 which is integrally formed with the leg 27 of the guide member 25 is struck therefrom with its free edge facing away from the lateral edges of the leg 27. The free end of the lug 37 has a nose 39 which may be stamped.

In the illustrated embodiment leg 27 of the guide member 25 is substantially longer than leg 26 but this is not mandatory.

Each of the entrance passages 14 in the housing 13 is provided with a leaf spring 40 having a portion angled with respect to the axis of the entrance passage, extending between the legs 26 and 27 of the guide member 25. The angled portion of the leaf spring 40 is adapted to clamp the conductive core 12 against the leg 26 of the guide member when the conductive core 12 of an electrical conductor 11 is inserted in the entrance passage 14. In the illustrated embodiment there are three such leaf springs 40. In actual practice, as is known per se, the leaf springs 40 are formed from the same part, separated by slots 42 therein. It is advantageous for the opposed edges of the slots 42 between two adjacent leaf springs 40 to be spaced apart.

According to the invention the or each leaf spring 40 is provided with means for clipping the leaf spring on the leg 27 of the guide member 25 including a bent-over portion 43.

Preferably, such a bent-over portion is obviously common to all the leaf springs 40, being part of the leaf spring part 41 in which all three leaf springs are defined.

Preferably, as illustrated, the means for clipping the leaf spring on the leg 27 of the guide member 25 comprises a bowed resilient portion 44. Thus, the means for clipping the leaf spring 40 on the leg 27 of the guide member 25 includes a fulcrum or inflection zone 45 bearing against the inner surface of leg 27. The bent-over portion 43 further includes a flat part 47 which bears against the outer surface of leg 27.

In the illustrated embodiment the flat part 47 comprises two openings which cooperate with the lugs 37 protruding from the outer surface of leg 27 of the guide member 25 and acting as a stop.

It is to be noted that owing to this simple clipping of the leaf spring on the guide member, the cross dimensions of the electrical connector 10 are essentially determined by the spacing between the legs 26, 27 of the guide. The additional thickness protruding from the outer surface of the leg 27 of the guide member caused by the securement of the leaf spring 40 is practically no greater than the thickness of the leaf spring itself.

Figure 2:
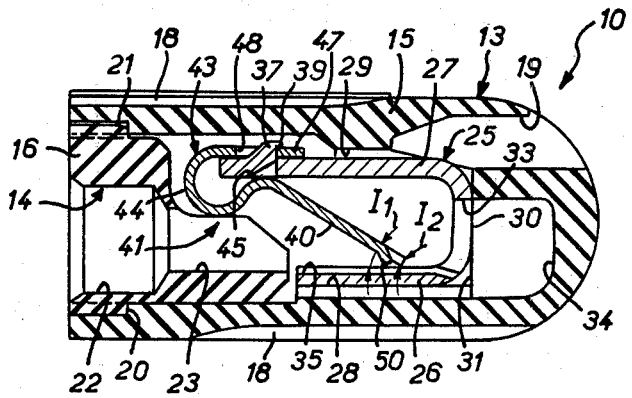
FIG. 2 shows an enlarged longitudinal sectional view of the electrical connector taken along line II—II in FIG. 1.
Figure 3:
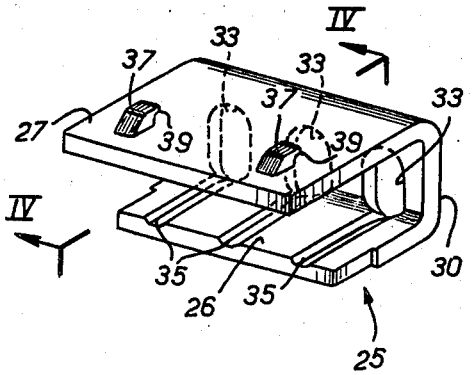
FIG. 3 shows a perspective view of the guide member for the electrical connector, taken on its own.
Figure 4:
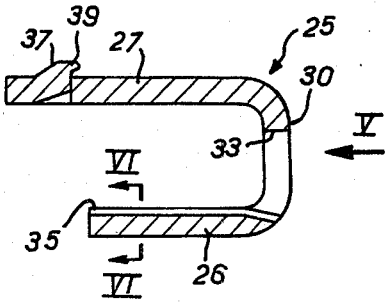
FIG. 4 shows a longitudinal sectional view of the guide member taken on the line IV—IV in FIG. 3.
Figure 5:
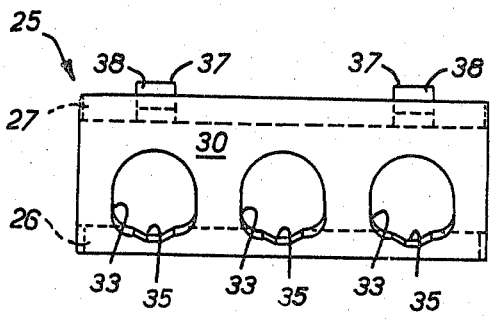
FIG. 5 shows an elevational view taken in the direction of arrow V in FIG. 4.
Figure 8:
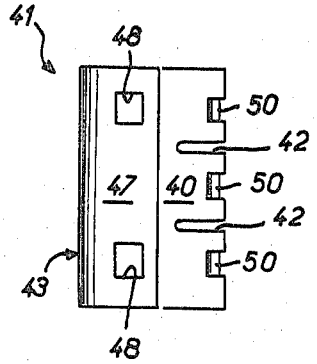
FIG. 8 shows a plan view of the part viewed in the direction of arrow VIII in FIG. 7.
Figure 9:
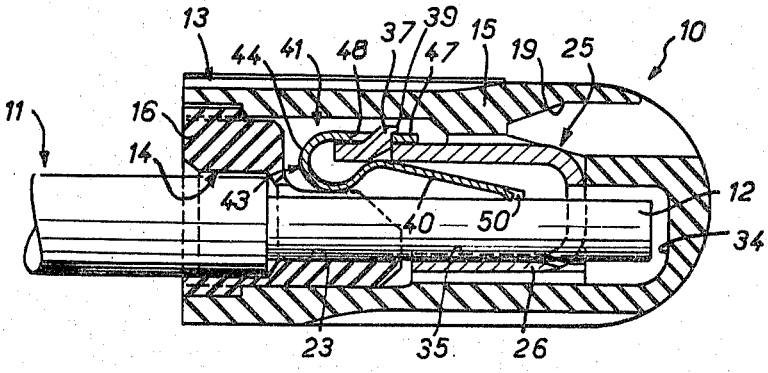
FIG. 9 shows a similar view to that of FIG. 2 when at least one electrical conductor is inserted in the electrical conductor.

A strike or tongue 50 at the free end of the angled portion of the leaf spring 40 is struck, e.g., stamped out for cooperation with the conductive core 12 of an electrical conductor 11, see FIGS. 1 and 8. The strike or tongue 50 is bent toward the leg 26 of the guide member 25. The angle I1 the tongue or strike 50 makes with the leg 26 is therefore greater than the angle I2 which the rest of the angled portion of the leaf spring makes with the leg 26 as shown in FIG. 2. The angle I1 is, for example, of the order of 30° to 35° in the rest position of the leaf spring 40, that is, before insertion of a conductive core.

It should be emphasized that the active edge of the strike or tongue 50 which forms the active or biting part of the entire leaf spring 40 is longitudinally offset with respect to the free edge of the rest of the angled portion of the leaf spring 40. But only the free edge of the rest of the angled portion of the leaf spring is adapted to bear against the leg 26 of the guide in the rest position illustrated in FIG. 2.

After stripping the end of the insulation around the conductive core 12, the electrical conductor or lead 11 is inserted in the electrical connector through one of the entrance passages 14 in the housing 13, the conductive core 12 urging the leaf spring 40 out of its path of insertion. The leaf spring 40 then presses or clamps the conductive core 12 against the leg 26 of guide member 25, the resilience being due to the inherent bending resilience as well as the inherent torsional resilience of the bowed portion 44 of the bent-over portion.

Under the corresponding resilient load the tongue or strike 50 anchors itself in the conductive core 12 and thereafter prevents the electrical conductor from being simply pulled out of the electrical connector. Indeed, if the electrical conductor is attempted to be pulled out of the electrical connector, the leaf spring 40 flexes or arches itself between the tongue or strike 50 which bites into the conductive core 12 of the electrical conductor 11 and thus effectively bears against the leg 26 of the guide member 25, and the fulcrum or inflection zone 24 of the bent-over portion which bears against leg 27 of the guide member. The leaf spring 40 is thus permanently arched between the legs 26, 27 of the guide member 25.

In practice the withdrawal of the electrical conductor 11 is still possible by a combination of alternating rotations of the conductor 10 with traction force. The removal of the electrical conductor cannot therefore be the result of an inadvertent action.

As previously mentioned it is to be emphasized that taking into account the location of the guide member 25 in the housing 13, the bight portion 30 of the guide member 25 extends beyond the leaf spring 40 relative to the corresponding entrance passage 14 so that the conductive core 12 of the electrical conductor 11 is suitably guided from one side of the contact zone to the other side as defined by the leaf spring engagement with the conductive core, namely by the entrance passage 14 on one side of the contact zone and the corresponding aperture 33 in the bight portion of the guide member to the other side.

It is also observed that the conductive core 12 of the electrical conductor 11 is in addition suitably longitudinally positioned by its engagement in the groove 35 in the leg 26 of the guide member with which it is in contact.

The electrical connection from one of the electrical conductors 11 inserted in the connector to another electrical conductor inserted in the connector, is essentially accomplished by the guide member, the leaf springs 40, however, participate in carrying current between conductors when the part 41 in which the leaf springs are formed is, as is usually the case, made of metal. In practice it is formed from a spring steel blank suitably cutout and bent.

Finally, as it will be readily understood, although the clipping of the leaf spring part 41 on the leg 27 of the guide member suffices to insure its securement thereon, namely in the course of assembly, the lugs 37 protruding from the leg 26 of the guide member avoid the spring part 41 from gradually partially or entirely slipping off the leg of the guide member due to forces exerted in the course of repeated removals of conductors 11, as described above.

Obviously, the invention is not intended to be limited to the illustrated and described embodiment but on the contrary is intended to cover all modifications and alternatives understood by those skilled in the art, without departing from the scope of the invention defined by the appended claims.

Further, the invention is not limited to electrical connectors in which there is an electrical connection between electrical conductors but as mentioned above includes terminal blocks in which there is no electrical interconnection between electrical conductors, the electrical conductors being electrically isolated from one another. The device according to the invention is likewise suitable for providing a terminal block for even a single electrical conductor.

What is claimed is:

1. A self-clamping electrical connecting device comprising an insulating housing, at least one entrance passage for inserting a conductive core of a lead, a U-shaped metal guide member, and a leaf spring member having a portion angled with respect to the axis of said entrance passage and extending between legs of said U-shaped guide member, said angled portion of said leaf spring member being adapted to clamp upon insertion the conductive core of the lead against one of the legs of said guide member, said leaf spring member comprising resilient clipping means extending around the free end of the other leg of said guide member and bearing on the inner and outer surfaces thereof.

2. The electrical connecting device according to claim 1, wherein said resilient clipping means comprises a bowed resilient portion.

3. The electrical connecting device according to claim 1, wherein said angled portion has a strike at its free end bent toward said one leg of said guide member.

4. The electrical connecting device according to claim 3, wherein the said strike is bent out of the plane of the rest of the angled portion of the leaf spring, its free edge being closer to said entrance opening than the free edge of the angled portion.

5. The electrical connecting device according to, claim 1 wherein said resilient clipping means of said leaf spring comprises an aperture, means defining a lug integrally formed with said other leg of said guide member inserted through said aperture in said resilient clipping mean.

6. The electrical connecting device according to claim 5, wherein said lug comprises an outwardly protruding strike in said other leg of said guide member having a nose at the free end of the strike protruding generally toward the bight of said guide member.

7. The electrical connecting device according to claim 1, wherein said guide member has an apertured bight in alignment with said entrance passage and remote therefrom relative to said angled portion of said leaf spring member, said apertured bight being adapted to receive the core of the associated lead.

8. The electrical connecting device according to claim 1, wherein said one leg of said guide member has a longitudinal groove running parallel to the axis of said entrance passage configurated to receive the conductive core of the lead.

9. The electrical connecting device according to claim 8, wherein said longitudinal groove has a trapezoidal cross-section.

10. The electrical connecting device according to claim 1, there being a plurality of said leaf spring members, slits separating adjacent edges of adjacent said leaf spring members.

11. The electrical connecting device according to claim 1, wherein said housing comprises a hollow body with an end having a plurality of spaced apart entrance passages.

12. A self-clamping electrical connecting device comprising an insulating housing, at least one entrance passage for inserting a conductive core of a lead, a U-shaped metal guide member and a leaf spring member having a portion angled with respect to the axis of said entrance passage and extending between legs of said U-shaped guide member, said angled portion of said leaf spring member being adapted to clamp upon insertion the conductive core of the lead against one of the legs of said guide member, said leaf spring member comprising resilient clipping means including a bent over resilient portion for clipping said leaf spring member on the other leg of said guide member, a fulcrum zone being formed between the angled portion and the bent-over resilient portion, said fulcrum zone bearing against the inner surface of said other leg, and said bent-over resilient portion comprising a flat part bearing against the outer surface of said other leg.

13. The electrical connecting device according to claim 12, wherein said resilient clipping means comprises a bowed resilient portion.

14. The electrical connecting device according to claim 12, wherein said angled portion has a strike at its free end bent toward said one leg of said guide member.

15. The electrical connecting device according to claim 14, wherein the said strike is bent out of the plane of the rest of the angled portion of the leaf spring, its free edge being closer to said entrance opening than the free edge of the angled portion.

* * * * *